US011725414B2

(12) United States Patent
Langenwalter et al.

(10) Patent No.: US 11,725,414 B2
(45) Date of Patent: Aug. 15, 2023

(54) MODULAR FENCE SYSTEM

(71) Applicant: ORIGIN POINT BRANDS LLC, North Charleston, SC (US)

(72) Inventors: Duane E. Langenwalter, Monroe, CT (US); Basil C. Peyton, Duluth, GA (US)

(73) Assignee: ORIGIN POINT BRANDS LLC, Summerville, SC (US)

( * ) Notice: Subject to any disclaimer, the term of this patent is extended or adjusted under 35 U.S.C. 154(b) by 604 days.

(21) Appl. No.: 16/312,134

(22) PCT Filed: Jun. 6, 2017

(86) PCT No.: PCT/US2017/036102
§ 371 (c)(1),
(2) Date: Dec. 20, 2018

(87) PCT Pub. No.: WO2017/214109
PCT Pub. Date: Dec. 14, 2017

(65) Prior Publication Data

US 2019/0226230 A1 Jul. 25, 2019

Related U.S. Application Data

(60) Provisional application No. 62/346,241, filed on Jun. 6, 2016.

(51) Int. Cl.
*E04H 17/16* (2006.01)
*E04H 17/18* (2006.01)
*E06B 11/02* (2006.01)

(52) U.S. Cl.
CPC ..... *E04H 17/185* (2021.01); *E04H 17/161* (2013.01); *E04H 17/18* (2013.01); *E06B 11/021* (2013.01)

(58) Field of Classification Search
CPC ..... E04H 17/16; E04H 17/161; E04H 17/163; E04H 17/18; E04H 17/185
(Continued)

(56) References Cited

U.S. PATENT DOCUMENTS 716,837 A * 12/1902 Gordon ..... E04H 17/18 256/33
905,983 A * 12/1908 Brown ..... A01G 17/06 256/33
(Continued)

FOREIGN PATENT DOCUMENTS

DE 20013351 U1 * 12/2001 ..... E04H 17/161
EP 1152105 A2 * 11/2001 ..... E04H 17/161
(Continued)

OTHER PUBLICATIONS

Lucchesi, Device for connecting fencing wire mesh to fence posts, 2004, EP 1422362 A2, Google Patents Translation (Year: 2004).*
(Continued)

*Primary Examiner* — Michael P Ferguson
*Assistant Examiner* — Zachary A Hall
(74) *Attorney, Agent, or Firm* — Parker Poe Adams & Bernstein, LLP

(57) ABSTRACT

A modular fence system includes a plurality of fence panels, each having top, bottom, left side, and right side edges. The left side edge may define a first profile, and he right side edge may define a second profile, the second profile being complementary to the first profile, whereby the left side edge of one panel may be disposed in side-by-side relationship to the right side edge of a second panel. The top, bottom, left side, and right side edges may define a periphery, with a plurality of barrier members residing within the periphery. Each panel may also include a strengthening feature integral with a plurality of the barrier members. A first hinge may
(Continued)

carried on the left side edge, and a second hinge carried on the right side edge and configured to align with the first hinge.

23 Claims, 9 Drawing Sheets

(58) Field of Classification Search
USPC ..... 256/26, 32, 33
See application file for complete search history.

(56) References Cited

U.S. PATENT DOCUMENTS 1,655,764 A * 1/1928 Gehrts ..... E04H 17/04 246/10
3,204,606 A 9/1965 Parr
3,651,851 A 3/1972 Curtis
3,774,947 A 11/1973 Duncan
4,050,606 A * 9/1977 Jurasek ..... B65D 19/12 220/7
4,553,740 A 11/1985 Bailey
4,595,176 A * 6/1986 Crabtree ..... E04H 17/10 256/47
4,685,656 A * 8/1987 Lee ..... E01F 15/025 256/13.1
4,739,579 A * 4/1988 Jakimas ..... A01K 69/10 43/102
4,790,578 A * 12/1988 Barrera ..... E05B 65/0007 292/148
5,542,649 A 8/1996 Allegaert et al.
5,593,141 A 1/1997 Cain
5,779,227 A 7/1998 Elkins
7,918,188 B1 * 4/2011 Harper ..... A01K 1/0245 119/481
9,057,168 B1 * 6/2015 Dugan, Jr. ..... E02D 29/0208
10,738,425 B2 * 8/2020 Heselden ..... E02D 29/0208
2002/0027225 A1 3/2002 Saura Sotillos et al.
2004/0188667 A1 * 9/2004 Ray ..... E04H 17/18 256/67
2005/0284080 A1 * 12/2005 Gallego ..... E01F 8/025 52/648.1
2007/0252125 A1 11/2007 Thompson
2009/0230373 A1 9/2009 Helseden
2009/0283734 A1 * 11/2009 Penning ..... E04H 17/163 256/65.14
2009/0321701 A1 * 12/2009 Payne ..... E04H 3/08 256/57
2010/0064627 A1 * 3/2010 Heselden ..... E02B 3/124 52/745.09
2011/0114910 A1 * 5/2011 Stuckel ..... E04H 17/10 256/24
2011/0305511 A1 * 12/2011 Heselden ..... E02B 3/04 405/16
2014/0203233 A1 * 7/2014 Larsen ..... E04H 17/161 256/32

FOREIGN PATENT DOCUMENTS

EP 1422362 A2 * 5/2004 ..... E04H 17/161
FR 2915224 A1 * 10/2008 ..... E04H 17/16
GB 2167786 A 6/1986
GB 2442338 A * 4/2008 ..... F16B 7/048
GB 2480324 A * 11/2011 ..... E02B 3/04
KR 20080015849 A * 2/2008 ..... E04H 17/18
WO WO-2010001478 A1 * 1/2010 ..... E01F 7/045

OTHER PUBLICATIONS

Extended European Search Report re: application 17810833.8, dated Mar. 25, 2020.

* cited by examiner

*Fig. 4*
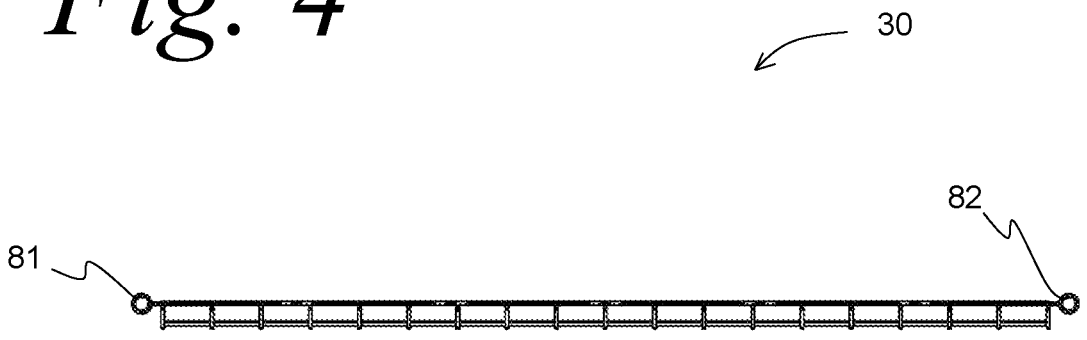
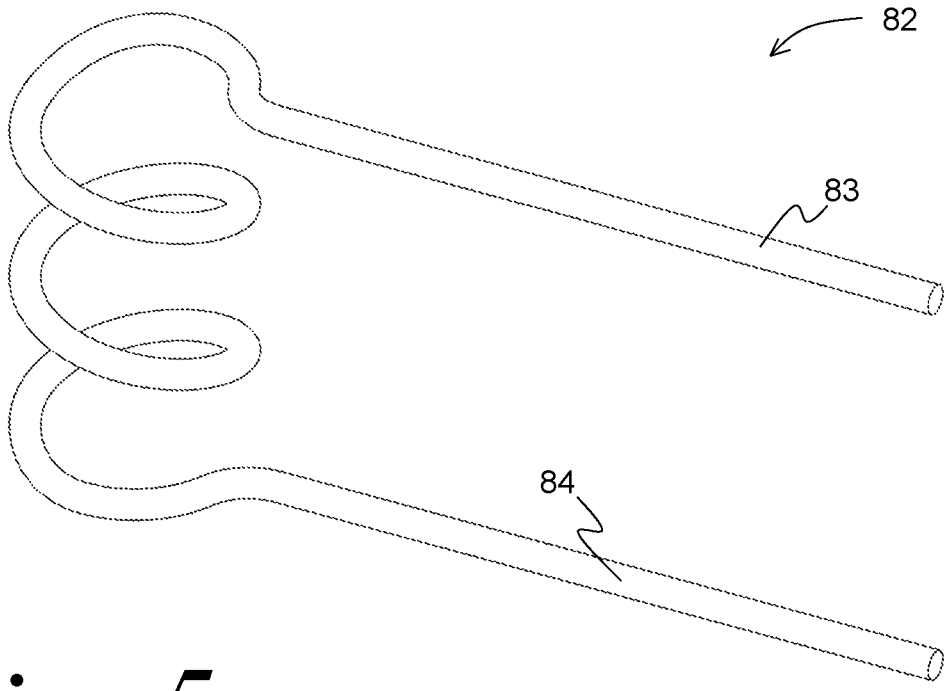
*Fig. 5*

*Fig. 6*
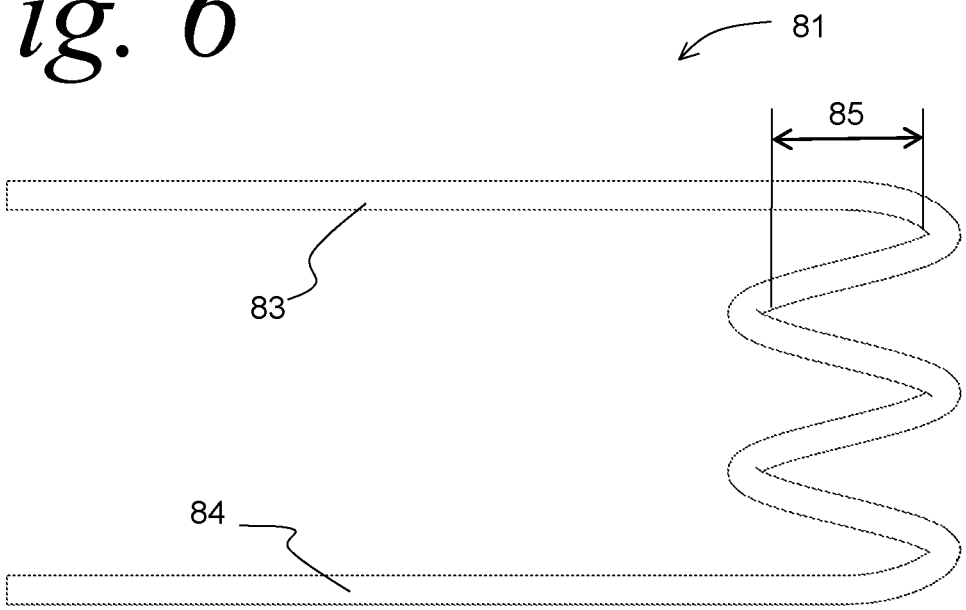
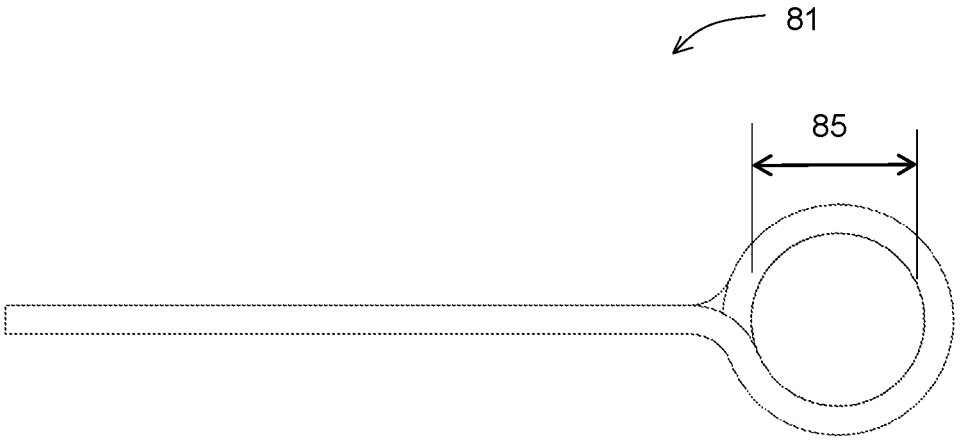
*Fig. 7*

*Fig. 10*
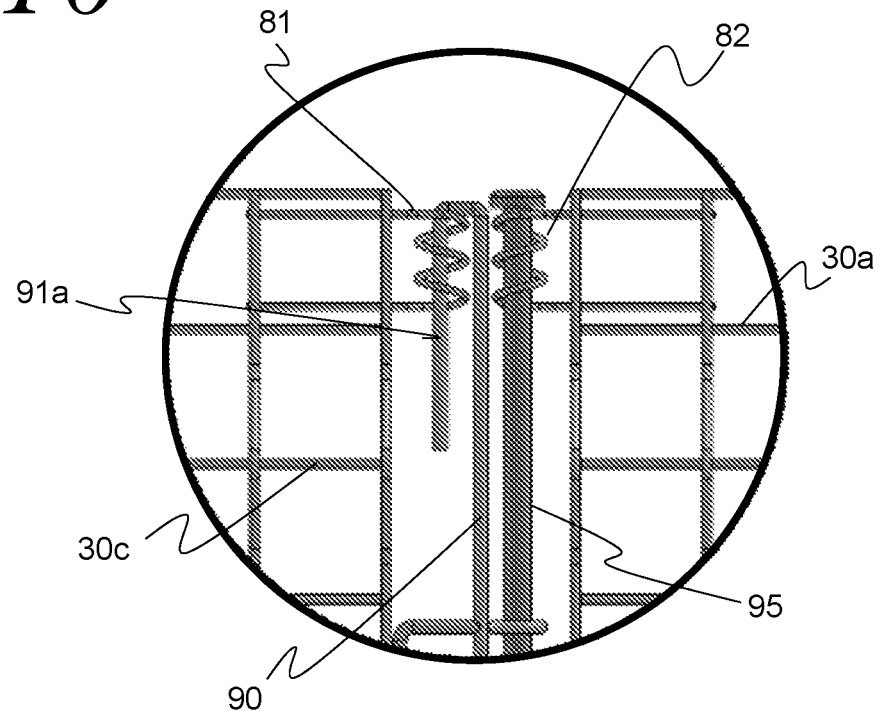
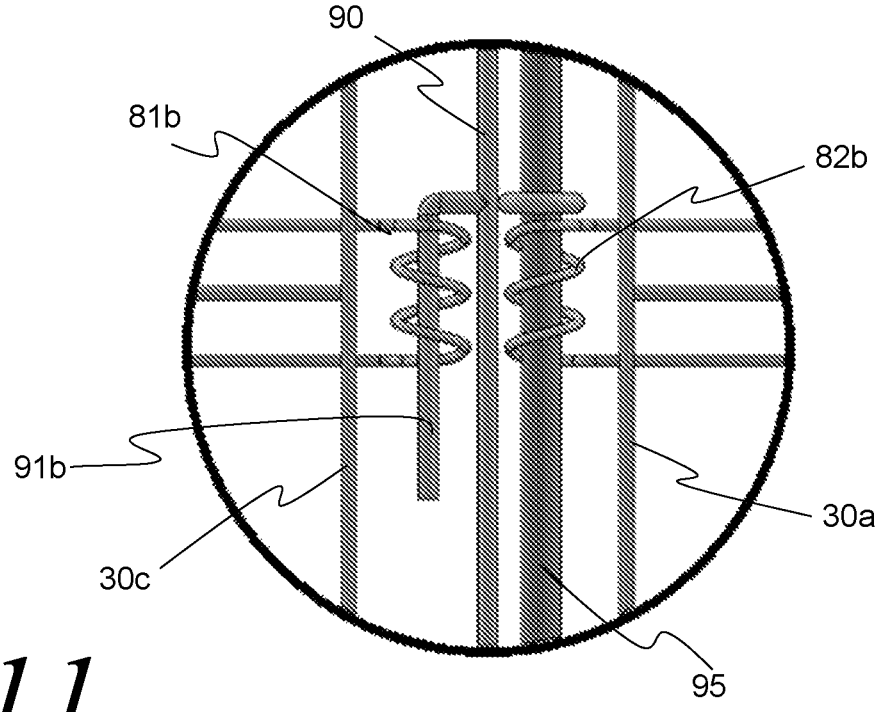
*Fig. 11*

MODULAR FENCE SYSTEM

TECHNOLOGICAL FIELD

This disclosure relates to a modular fence system. More particularly, it relates to a fence system with modular panels, each panel carrying outboard helical connectors, the system also including a latch by which a panel may be thereby used as a gate.

CROSS-REFERENCE TO RELATED APPLICATIONS

This application claims the priority benefit of Provisional U.S. Patent Application Ser. No. 62/346,241 filed on Jun. 6, 2016, the entire scope and content of which are hereby incorporated herein by reference.

BACKGROUND OF THE INVENTION

A fence is a barrier. It marks a boundary, controls access, provides an enclosure, protects, and/or decorates. An upright structure, historically a fence has been made of wood or metal.

And historically a fence has not been easy to construct. Usually posts must first be embedded in the ground, often in concrete, their locations premeasured. Railings, mesh, pickets, and like barrier elements are then attached to the posts, requiring additional labor. Once installed, the fence, so constructed, is difficult to relocate.

Premanufactured fencing components lessen some of that labor. For example, if the posts are first properly located and installed, and carefully distanced from each other so as to receive the premanufactured barrier elements, premanufactured barrier elements might be affixed in between the posts, thereby reducing some of the labor. However, such an improvement has not fully provided for ease and flexible installation by the end use.

It is more desirable for fencing to be available as fully pre-assembled as possible, yet adaptable for user preferences, as pre-assembly would simplify installation and would reduce costs as a result of economies of scale.

Modularity of pre-assembled fencing panels is also desirable. Inasmuch as plans may be altered during installation of fencing, or additional fencing may be discovered to be desirable after installation of an initial run, or later replacement may be desired of a section of fencing damaged after installation, modularity of design would allow easy and aesthetically matching and consistent final results.

It would also be desirable to provide a fence design with components that may be manufactured at a first location better suited for efficient manufacturing, and shipped to a second location for sale to an end user, who might then easily assemble the components into a finished barrier. In such a context, it would be desirable for a fencing design to comprise a minimal number of components. Ideally, those same components should at the same time be of a design allowing efficient connectivity, preferably requiring use only of simple and inexpensive tools, and, once assembled, complement the structural function of each other.

Finally, for fencing designed to be manufactured at a first location and shipped to a second location for final assembly into finished barrier, it would be desirable for the design of the fencing components and the finished assembly to be such that the finished assembly is sturdy, structurally sound, tight, and without loose parts.

The fencing products previously known do not ideally address the foregoing objectives.

BRIEF SUMMARY OF THE INVENTION

In response to the difficulties and problems encountered before, a new modular fence system has been discovered that is simple, easy to use, includes a minimal number of components, and provides for great versatility to the user.

In accordance with certain aspects of certain embodiments of the present technology, a modular fence system includes a plurality of fence panels, each fence panel having a top edge and an opposed bottom edge, a left side edge and an opposed right side edge. The left side edge may define along its length a first profile, and the right side edge may define along its length a second profile, the second profile being complementary to the first profile, whereby the left side edge of a first panel may be disposed in side-by-side relationship along its length to the right side edge of a second panel along its length. The top edge, bottom edge, left side edge, and right side edge may define a periphery, with a plurality of barrier members residing within the periphery. Each panel may also include a strengthening feature, the strengthening feature integral with a plurality of the barrier members. Further, each panel may include a first hinge, the first hinge carried on the left side edge, and a second hinge, the second hinge carried on the right side edge and configured to align with the first hinge of a second panel.

In accordance with additional aspects of other embodiments of the present technology, the top edge and the bottom edge of each panel may reside in a single plane, and the strengthening feature may reside outside the single plane.

In accordance with yet additional aspects of other embodiments of the present technology, a first group of the barrier members may cross a plurality of the remaining members of the barrier members.

In accordance with still further aspects of other embodiments of the present technology, each barrier member may have a first end and an opposed second end, and the first and second ends of the barrier members may reside within the periphery.

In accordance with yet still further aspects of other embodiments of the present technology, a first group of the barrier members may be generally horizontal and a plurality of the remaining members of the barrier members may be generally vertical. In particular embodiments, the generally horizontal barrier members may be attached to a plurality of the generally vertical barrier members. In certain configurations, the generally horizontal barrier members are attached to all of the generally vertical barrier members.

Some examples of the modular fence system may include first and second hinges that are helical and disposed outboard of the panel. In individual forms of some embodiments, the hinges may each attached to a vertical barrier member.

Selective illustrations of the modular fence system may include the top edge, bottom edge, left side edge, and right side edge of each panel each defining a side length, each edge being devoid of additional elements having the side length.

In accordance with other aspects of other embodiments of the present technology, a modular fence system may include a plurality of fence panels, each fence panel having a first plurality of barrier members residing horizontally in a parallel relationship to one another, and a second plurality of barrier members residing vertically in a parallel relationship to one another. Each horizontal barrier member may be attached to a plurality of the vertical barrier members. The uppermost horizontal barrier member may define a top edge to the panel and the lowermost horizontal barrier member may define a bottom edge to the panel. The left-most vertical barrier member may define a left edge to the panel and further define a first profile along its length. The right-most vertical barrier member may define a right edge to the panel and further define a second profile along its length, the second profile being complementary to the first profile, whereby the left edge of a first panel may be disposed in side-by-side relationship along its length to the right edge of a second panel along its length. A first strengthening feature may be included, the first strengthening feature integral with a plurality of the vertical barrier members. Each panel may also include a first hinge, the first hinge carried on and outboard of the left edge, and a second hinge, the second hinge carried on and outboard of the right side edge and configured to align with a the first hinge of a second said panel.

In accordance with additional aspects of other embodiments of the present technology, the top edge and the bottom edge of each panel may be parallel and define between them a plane, and the first strengthening feature may reside outside the plane.

In accordance with yet additional aspects of other embodiments of the present technology, each horizontal barrier member may be attached to each of vertical barrier members.

In accordance with still further aspects of other embodiments of the present technology, each panel further may include a second strengthening feature, the second strengthening feature residing outside the plane, the first strengthening feature located proximate to the top edge, the second strengthening feature located proximate to the bottom edge.

In accordance with yet still further aspects of other embodiments of the present technology, the first and second hinge of each panel may be helical, may be identical, may each attached to a vertical barrier member, and may each be outboard of the panel.

In particular configurations, the top edge, bottom edge, left edge, and right edge of each panel may each define a side length, each of the edges being devoid of additional elements having said side length.

In certain examples, the uppermost horizontal barrier member, the lowermost horizontal barrier member, the left-most vertical barrier member, and the right-most barrier member of each panel may define a panel periphery, and the entireties of the other horizontal and vertical barrier members may reside within the panel periphery.

In accordance with other certain aspects of some embodiments of the present technology, a modular fence system may include a plurality of fence panels, each fence panel being identical. Each fence panel may have a first plurality of barrier members, the first plurality of barrier members being identical, being rectilinear, and residing horizontally in parallel spaced-apart relationship to one another. A second plurality of barrier members may reside vertically in parallel spaced-apart relationship to one another. Each horizontal barrier member may be attached to a plurality of vertical barrier members. The uppermost horizontal barrier member, the lowermost horizontal barrier member, the left-most vertical barrier member, and the right-most vertical barrier member may together define the periphery of the fence panel, and the uppermost horizontal barrier member and the lowermost horizontal barrier member may be parallel and define between them a plane. The left-most vertical barrier member may define a first profile along its length and the right-most vertical barrier member may define a second profile along its length, the second profile being complementary to the first profile, whereby the left edge of a first panel may be disposed in side-by-side relationship along its length to the right edge of a second panel along its length. A first vertical barrier member and a second vertical barrier member of the second plurality may be identical, may each be formed to include along its length a third profile, the third profile residing outside the plane, wherein the third profiles of the first and second vertical barrier members together may define a first strengthening feature. A first and second hinge may also be included. The first hinge may be carried on the left edge and the second hinge may be carried on the right edge and configured to align with a first hinge of a second panel.

In individual examples of the present technology, each horizontal barrier member may be attached to all of the vertical barrier members.

In some configurations, the first vertical barrier member and the second vertical barrier member of the second plurality may each also be formed to include along its length a fourth profile, the fourth profile residing outside the plane, wherein the fourth profiles of the first and second vertical barrier members together define a second strengthening feature. In certain embodiments, the first strengthening feature may be disposed proximate the uppermost horizontal barrier member and parallel thereto, and the second strengthening feature may be disposed proximate the lowermost horizontal barrier member and parallel thereto.

In specific illustrations, the lowermost horizontal barrier member, the left-most vertical barrier member, and the right-most vertical barrier member of each panel may each define a side length, each uppermost horizontal barrier member, lowermost horizontal barrier member, left-most vertical barrier member, and right-most vertical barrier member being devoid of additional elements of said side length.

In selective forms, a horizontal barrier member may be attached to the first strengthening feature.

In individual configurations, a first panel may be disposed adjacent to a second panel, the first hinge of the first panel being aligned with the second hinge of the second panel, and a post interfitted within the first and second hinges.

These and other features and their advantages will be apparent from a careful review of the Detailed Description below, accompanied by the following drawings.

BRIEF DESCRIPTION OF THE SEVERAL VIEWS OF THE DRAWING

The aspects described above, as well as other apparent aspects, advantages, and objective of the present invention are apparent from the detailed description below in combination with the drawings, in which:

FIG. 4 is a top view of a panel in accordance with an embodiment of the present invention;

FIG. 5 is a perspective view of a hinge in accordance with an embodiment of the present invention;

FIG. 6 is an elevation view of a hinge in accordance with an embodiment of the present invention.

FIG. 7 is a top view of a hinge in accordance with an embodiment of the present invention.

FIG. 10 is a magnified view, taken at A in FIG. 8;

FIG. 11 is a magnified view, taken at B in FIG. 8; and

DETAILED DESCRIPTION OF THE INVENTION

Figure 1:
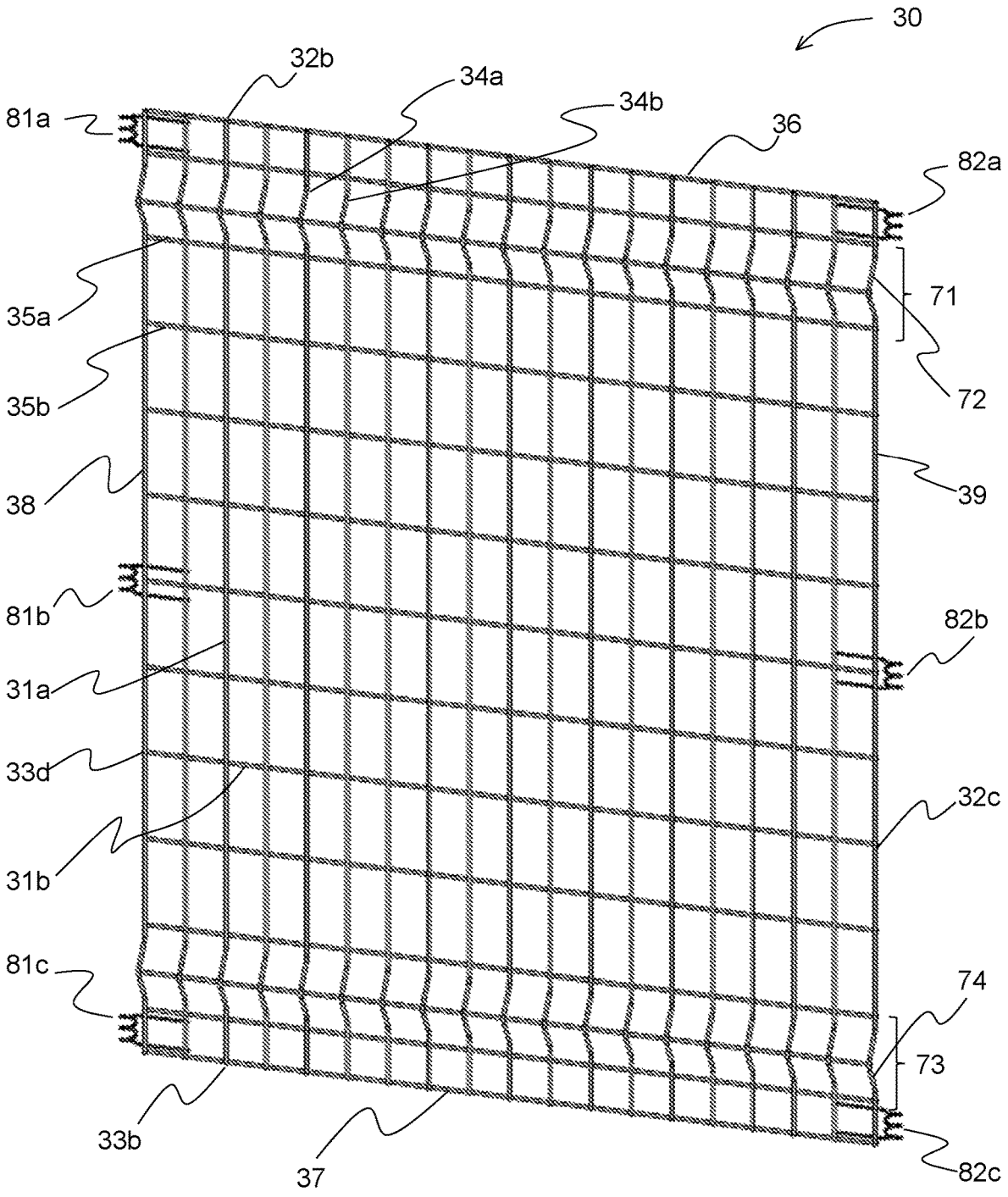
FIG. 1 a perspective view of a panel in accordance with an embodiment of the present invention.

The present invention may be understood more readily by reference to the following detailed description, examples, drawings, and claims, and their previous and following descriptions. However, it is to be understood that this invention is not limited to the specific devices, systems, and/or component disclosed unless otherwise specified, as such can vary. It is also to be understood that the terminology used herein is for the purpose of describing particular aspects only and is not intended to be limiting.

As used in the specification and the appended claims, the singular forms "a," "an" and "the" include plural referents unless the context clearly dictates otherwise. Thus, for example, reference to a "barrier member" can include two or more such barrier members unless the context requires otherwise.

A modular fence system 20 is provided. Modular fence system 20 comprises a minimum number of components. Modular fence system 20 includes a plurality of panels 30. Each panel 30 may be of any suitable material, and need not be of a single material but rather can be multiple materials together. Such materials may include metal, non-metal such as vinyl or plastic, fabrics such as fabric webbing, and the like.

Each panel 30 may be of any shape or geometry that includes a left side 53 and a right side 54. Each panel 30 may be planar, partially planar, or non-planar. In some embodiments, each panel 30 may be identical, but in other applications each such panel need not be identical to all other such panels 30 or identical to any other such panel 30.

Each panel 30 may define a periphery. More specifically, each panel 30 may include a top edge 51 and a bottom edge 52. Likewise, each panel 30 may include a left side edge 53 and a right side edge 54. Left side edge 53 may define along its length a first profile 61. Similarly, right side edge 54 may define along its length a second profile 62. Second profile 62 may be complimentary to first profile 61 whereby the left edge 53 of a first panel 30 may be disposed in side-by-side relationship along its length to the right edge 54 of a second panel 30 along its length.

The top edge 51, bottom edge 52, left side edge 53, and right side edge 54 of each panel 30 may each define a side length. More particularly, top edge 51 may define a first side length 41, bottom edge 52 may define a third side length 43, left side edge 53 may define a third side length 42, and right side edge 54 may define a fourth side length 44. Each side length 41, 42, 43, and 44 may be devoid of additional elements having the respective side lengths.

Top edge 51 of a panel 30 and bottom edge 52 of such panel 30 may reside in a single plane.

A plurality of barrier members 31 may reside within the periphery of a panel 30. Barrier members 31 may be metal or non-metal. Barrier members 31 may be of any advantageous cross-section, for examples, round, square, oval, or elliptical, and the cross-section or geometry may vary along the length of an individual barrier member 31. One barrier member 31 may be of a particular cross-section, yet another barrier member 31 in the same panel 30 may be of a different cross-section.

In one embodiment of modular fence system 20, barrier members 31 are of metal wire.

In a particular panel 30, a first group of barrier members 31 may cross a plurality of remaining barrier members 31. For example, such barrier members 31 in a particular panel 30 may be arranged in a diagonal and crossing orientation.

In one embodiment of system 20, a first plurality of barrier members 31, for example barrier members 35, may reside horizontally in parallel relationship to one another. A second plurality of barrier members 31, for example barrier members 34, may reside vertically in a parallel relationship to one another. In a particular embodiment, the generally horizontal barrier members, for example barrier members 35, may be attached to a plurality of the generally vertical barrier members, for example barrier members 34. In a still further embodiment, a single generally horizontal barrier member, for example barrier member 35, may be attached to all of the generally vertical barrier members, for example barrier members 34.

One example of system 20 includes panels 30 in which a first plurality of barrier members, for example barrier members 35, are identical, are rectilinear, and reside horizontally in a parallel, spaced-apart relationship to one another. Additionally, a second plurality of barrier members 31, for example barrier members 34, are identical and reside vertically in parallel, spaced-apart relationship to one another.

Each barrier member 31 may have a first end 32 and an opposed second end 33. Some, or all, of the first and second ends 31, 32 of the barrier members 31 may reside within the periphery of a panel 30.

The uppermost horizontal barrier member 31 of a panel 30 may define a top edge 51 of the panel 30. Likewise, the lower most horizontal barrier member 31 of a panel 30 may define a bottom edge 52 of the panel 30. The left-most vertical barrier member 31 may define a left edge 53 to the panel 30. Finally, the right-most vertical barrier member 31 may define a right edge 54 to the panel 30. The top edge 51, bottom edge 52, left edge 53, and right edge 54 may define a periphery of panel 30, and the entireties of the barrier members 31 of a given panel 30 may reside within the periphery of that panel 30.

In certain embodiments, a panel 30 may include only barrier members 31 and hinges, for example first hinge 81 and second hinge 82, and may be devoid of additional components.

Each panel 30 may include one or more strengthening feature, for example first strengthening feature 71. First strengthening feature 71 may be utilized so that panel 30 may resist lateral forces bearing upon it. First strengthening feature 71 may be integral with a plurality of barrier members 31. For example, a first barrier member 34*a* and second barrier member 34*b* may be identical, and each may be formed to include along its length a third profile 72, the third profile 72 residing outside the plane of the top edge 51 and bottom edge 52 wherein the third profile 72 of the first and second vertical barrier members 34*a*, 34*b* together define first strengthening feature 71.

In another embodiment, the first vertical barrier member 34*a* and the second vertical barrier member 34*b* may each be formed to include along its length a fourth profile 74, the fourth profile 74 residing outside the plane of the top edge 51 and bottom edge 52 of panel 30. In a particular application, the first strengthening feature 71 may be disposed proximate to top edge 51, and the second strengthening feature 73 may be located proximate to the bottom edge 52. In one embodiment, the first strengthening feature 71 may be disposed proximate to the uppermost horizontal barrier member 31 and parallel thereto, and the second strengthening feature 73 may be disposed proximate to the lower most horizontal barrier member 31 and parallel thereto.

One or more hinges may be provided for each panel 30 of system 20. For example, a first hinge 81 may be carried on left side edge 53. In particular applications, first hinge 81 may be carried outboard of left side edge 53. A second hinge 82 may be carried on the right side edge 54 of a panel 30, and be configured to align with the first hinge 81 of a second panel 30. In some embodiments, first and second hinges 81, 82 may be helical and, in particular applications, be disposed outboard of panel 30. Each hinge 81, 82 may be attached to a vertical barrier member 31. In some applications, first hinge 81 and second hinge 82 of each panel 30 may be helical, be identical to each other, and each may be attached to a vertical barrier member 31 outboard of the panel 30. Such attachment may be by welding, or may be by wrapping legs 83, 84 of hinge 81, 82 to a vertical barrier member 31. Similarly, hinges 81, 82 may simply be adhered to a vertical barrier member 31.

By positioning a first panel 30*a* and a second panel 30*b* adjacent to each other, with their respective hinges, for example 81*b*, 82*b*, engaged with each other and with their respective interior bores 85 aligned, a post 95 may be inserted through the interior bores 85 of each of hinges 81*b*, 82*b*, the post 95 then secured to the ground, for example by driving it into the ground, to secure system 20 in position for use.

Optionally, a latch 90 may be employed with system 20. Latch 90 may include one or more latch pins 91 and may also include one or more handles 92. Latch 90 may allow for a panel 30*a* to function as a gate through a system 20. More particularly, latch pin 91*a* may be engaged with a hinge, for example, hinge 81*a*, latch pin 91*b* being engaged with hinge 81*b*, and thereby a panel 30*a* may swing relative to an adjacent panel 30*b* once latch 90 is disengaged from the hinges 81*a*, 81*b*.

Furthermore, a post 95 is provided. Post 95 may be a rectilinear member defining a post thickness 96. Post thickness 96 is less than the interior bore 85 of a hinge, for example hinge 81 or hinge 82.

By use of the foregoing components, a first panel 30*a* may be disposed adjacent to a second panel 30*b*, the first hinge 81 of the first panel 30*a* being aligned with the second hinge 82 of the second panel 30*b*, and a post 95 interfitted with the first and second hinges 81, 82. In like fashion, a third panel 30*c* may be connected with either first panel 30*a* or second panel 30*b*. Further, additional panels 30 may be serially connected to first panel 30*a* or second panel 30*b* to create a linear fence system 20, a zig zag fence system 20, an enclosure, or boundary, or decoration of infinite shapes as the end user prefers. For example, once a third panel 30*c* is connected with a first panel 30*a*, it may then also be connected to a second panel 30*b* to create a triangular enclosure. Addition of a fourth panel 30*d* may be used to create a quadrilateral enclosure. Alternatively, a first panel 30*a* may be connected at its left side edge 53 to a second panel 30*b*, then a third panel 30*c* may also be connected to the left side 53 of first panel 30*a* to create a T-shaped barrier; additional panels 30 may then be attached to the right side edge 54 of panel 30*a* and to third panel 30*c* and to second panel 30*b* to create a barrier configuration desired by a particular end-user.

The accompanying figures illustrate certain of the foregoing aspects of system 20, as well as additional aspects thereof.

FIG. 1 illustrates a panel 30 of a system 20. Panel 30 includes plural barrier members 31, including vertical barrier members 34 and horizontal barrier members 35. Uppermost horizontal barrier member 36 and lowermost horizontal barrier member 37 are illustrated, as are left-most vertical barrier member 38, and right-most vertical barrier member 39. Barrier member 31*a*, a vertical barrier member, is shown to include first end 32*b*, and second end 33*b*. Barrier member 31*b*, a horizontal barrier member, is shown to include first end 32*c* and second end 33*d*. Horizontal barrier members 35*a* and 35*b* are also illustrated. Likewise, vertical barrier members 34*a* and 34*b* are illustrated.

FIG. 1 also illustrates third profile 72 as a component of strengthening feature 71, and fourth profile 74 as a component of second strengthening features 73.

FIG. 1 also illustrates an inclusion of first hinges 81*a*, 81*b*, and 81*c*. Likewise included are second hinges 82*a*, 82*b*, and 82*c*.

Figure 2:
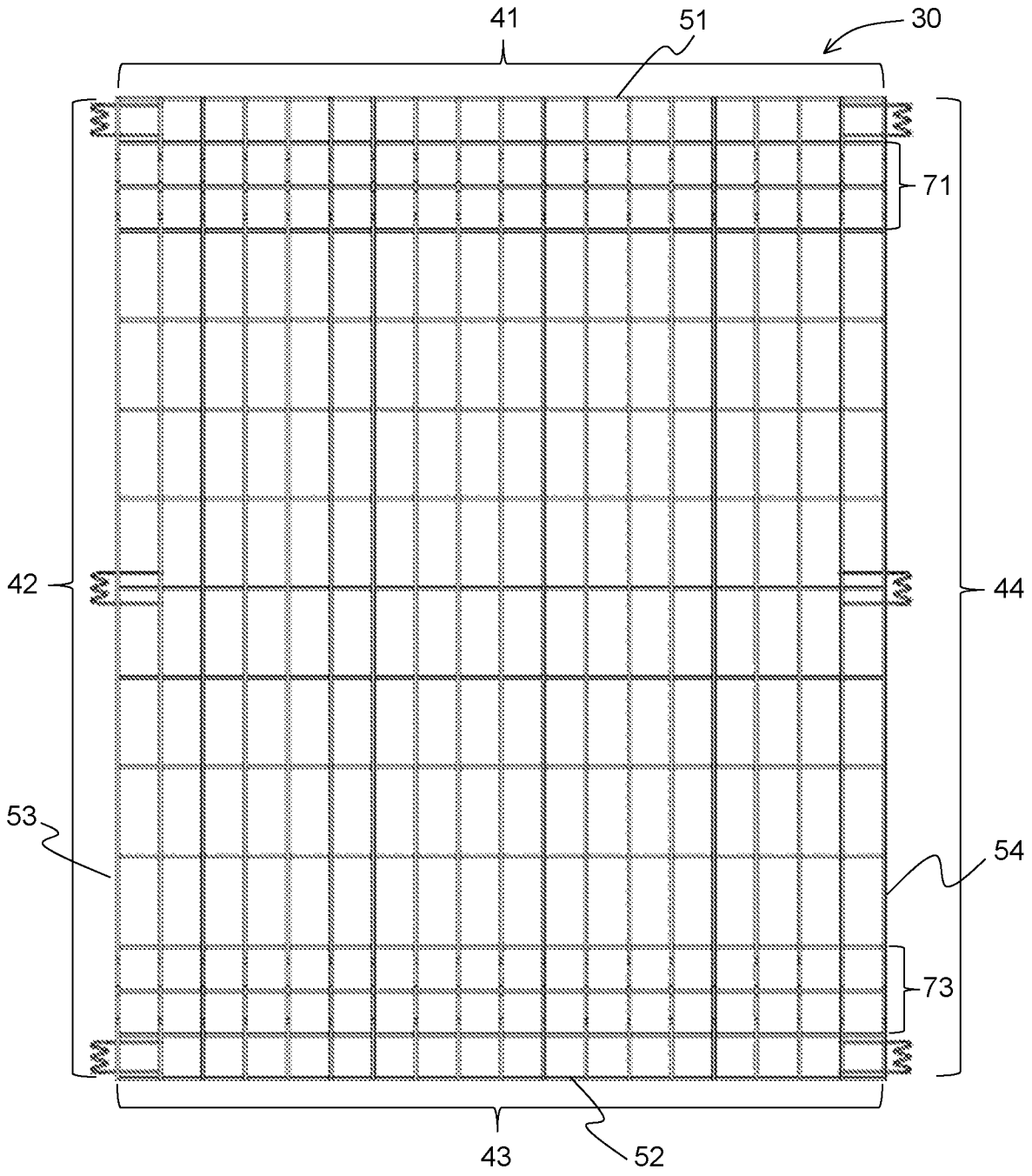
FIG. 2 is a front elevation view of a panel in accordance with an embodiment of the present invention.

FIG. 2 illustrates top edge 51, bottom edge 52, left side edge 53, and right side edge 54. As depicted therein, top edge 51 defines first side length 41. Left side edge 53 defines second side length 42. Bottom edge 52 defines third side length 43. Right side edge 54 defines fourth side length 44. Additionally illustrated in FIG. 2 is first strengthening feature 71 and second strengthening feature 73.

Figure 3:
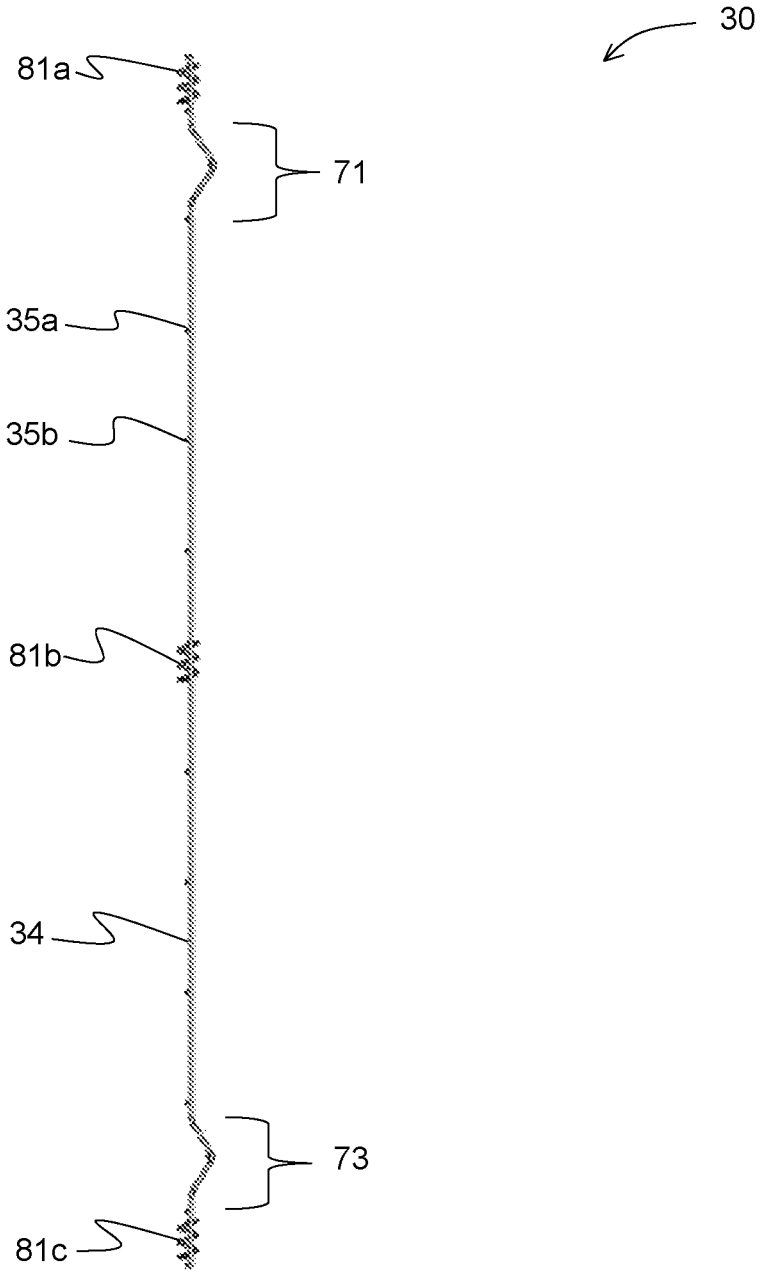
FIG. 3 is a side view of a panel in accordance with an embodiment of the present invention.

FIG. 3 is a side view of a panel 30. Illustrated therein a first hinges 81*a*, 81*b*, and 81*c*. Exemplary horizontal members 35*a* and 35*b* are also illustrated. First strengthening feature 71 and second strengthening feature 73 are illustrated along the length of vertical member 34.

FIG. 4 is a top view of a panel 30, showing the relative positioning of first hinge 81 and second hinge 82.

FIG. 5 is a close-up view of a hinge 82. As illustrated therein, in this embodiment hinge 82 includes a first leg 83 and a second leg 84, for attachment to a vertical barrier member 34 of a panel 30.

Likewise, FIG. 6 illustrates a first hinge 81. Defined between first leg 83 and second leg 84 is a helical portion that includes interior bore 85, through which a post 95, having a post thickness 96 that is less than interior bore 85, may be disposed. A similar view is included in FIG. 7.

Figure 8:
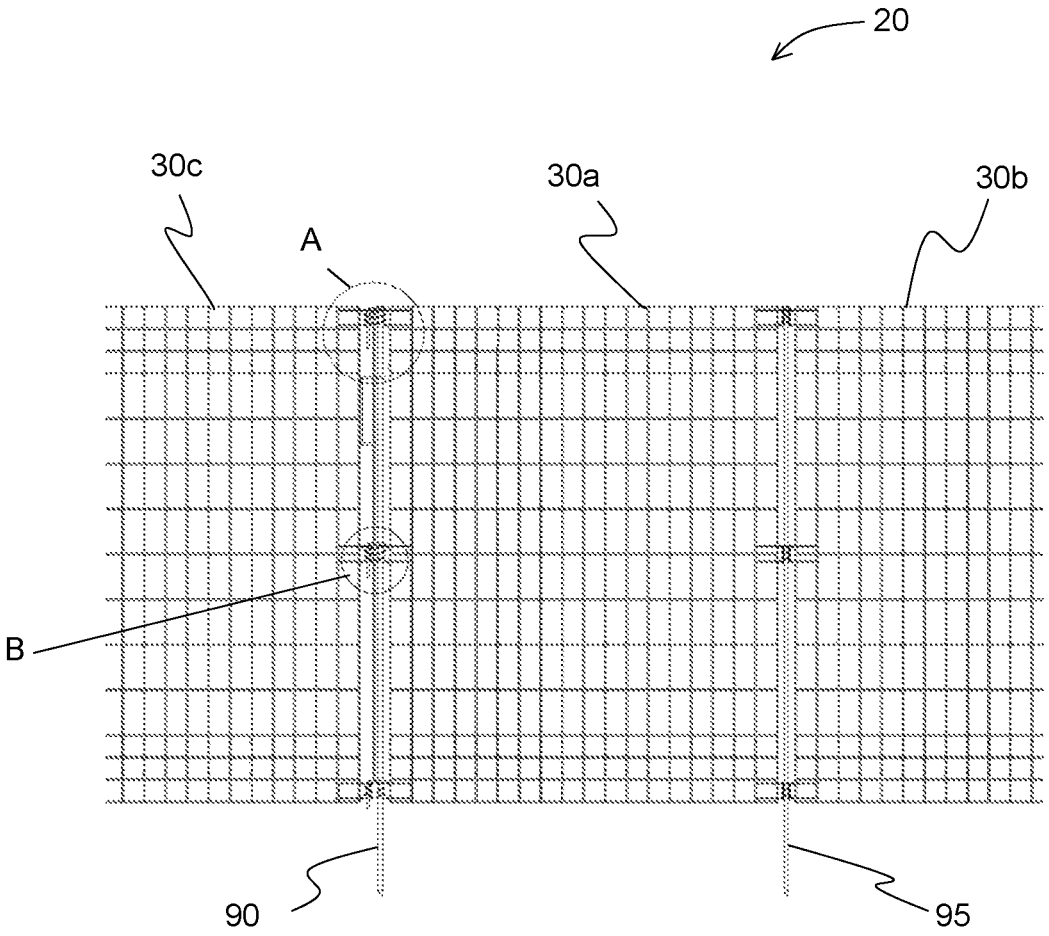
FIG. 8 is an elevation view of a modular fence system in accordance with an embodiment of the present invention.

FIG. 8 illustrates system 20 comprising panels 30*a*, 30*b*, and 30*c*. Panels 30*a*, 30*b* have been joined together by a post 95 through hinges disposed on panels 30*a*, 30*b* (not numbered). Opposite panel 30*b* is disposed a panel 30*c*. Panel 30*c* has been joined with panel 30*a* with a latch 90. So configured, panel 30*c* may serve as a gate, swinging relative to panels 30*a* and 30*b* once latch 90 is disengaged from panel 30*c*. The illustration of FIG. 8 discloses the versatility of system 20. By serially attaching various of panels 30 one to another, either with a posts 95 and/or latches 90, an infinite variety of configurations of system 20 may be constructed. For example, with four panels 30 so joined, a quadrilateral enclosure may be constructed. Additional panels, such as fifth, sixth, seventh, and so forth panels, may likewise be attached to instruct enclosures and/or barriers of an infinite number of configurations.

Figure 9:
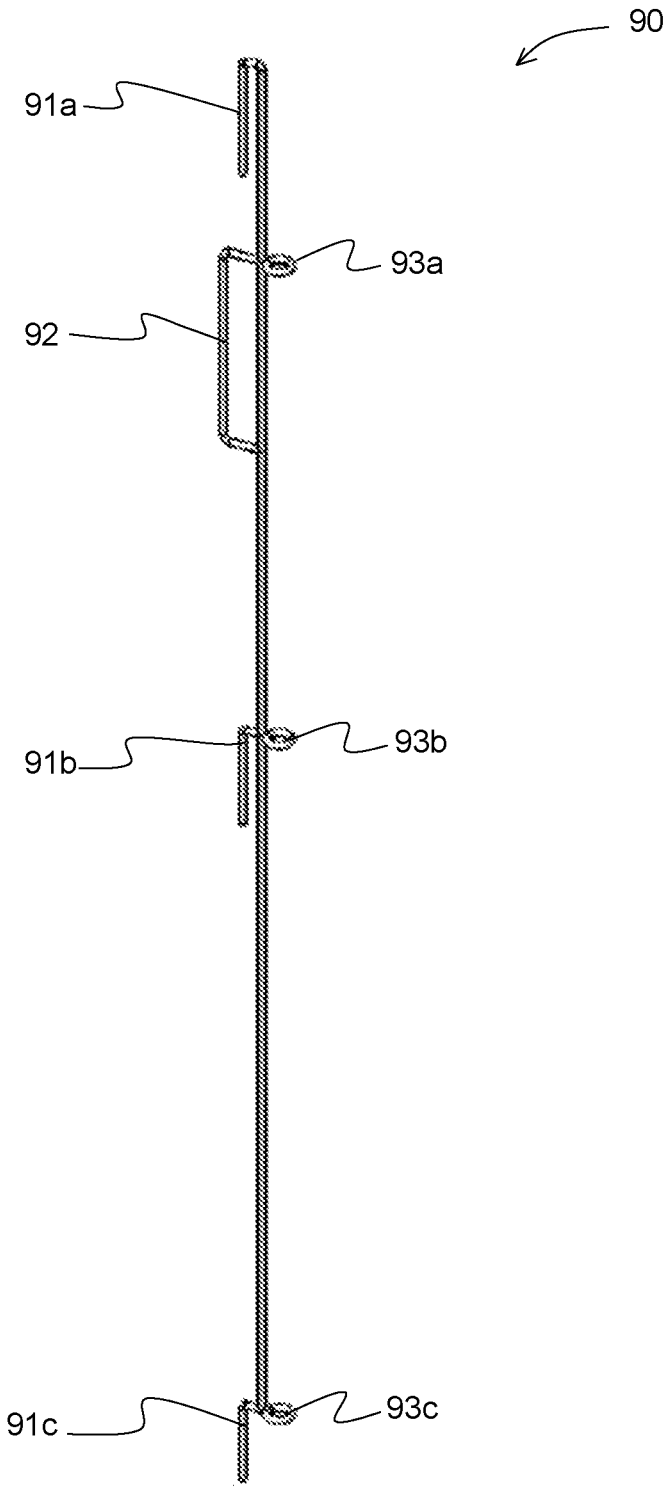
FIG. 9 is a perspective view of a latch in accordance with an embodiment of the present invention.

FIG. 9 is a detailed view of a latch 90. As illustrated therein, latch 90 includes latch pins 91*a*, 91*b*, 91*c*. In particular configurations, only a single latch pin 91 may be needed. Also included is a handle 92. Opposite latch pins

91*a*, 91*b*, and *c*, and handle 92 are apertures 92*a*, 92*b* and *c*, configured for receipt of a post 95 therethrough joining latch 90 with a panel 30.

FIGS. 10 and 11 are close up views showing use of a post 90 and a latch 91 as illustrated in FIG. 8.

Figure 12:
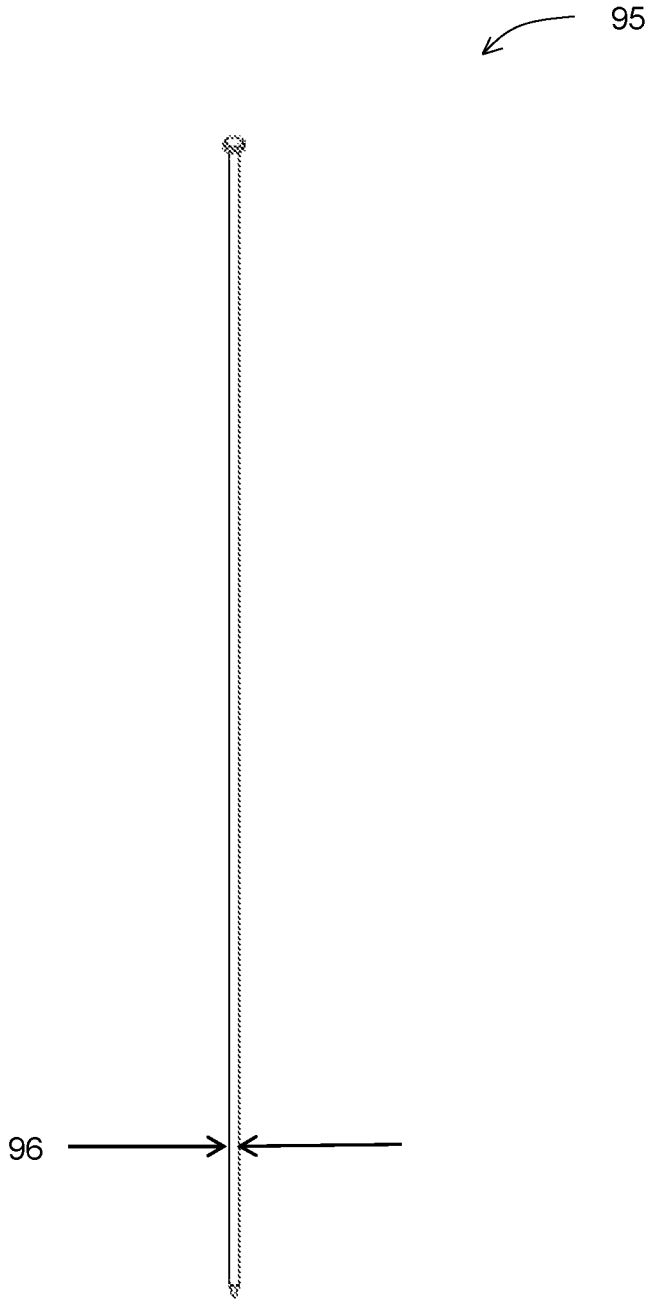
FIG. 12 is an elevation view of a post in accordance with an embodiment of the present invention.

Finally, FIG. 12 shows a post 95 having a post thickness 96.

While the particular modular fence system as herein disclosed, illustrated, and described is to be understood as only an embodiment of the present invention and thus representative of the subject matter which is broadly contemplated by the present invention. The scope of the present invention fully encompasses other embodiments that may be or may become obvious to those skilled in the art, and the scope of the present invention is accordingly to be limited by nothing other than the appended claims. In the appended claims, reference to an element in the singular is not intended to mean "one and only one" unless explicitly so stated, but rather "one or more". All structural and functional equivalents to the elements of the above-described embodiment that are known or later come to be known to those of ordinary skill in the art are expressly incorporated herein by reference and are intended to be encompassed by the present claims. Moreover, it is not necessary for a device to address each and every problem sought to be solved by the present invention for it to be encompassed by the present claims. Furthermore, no element, component, or combination in the present disclosure is intended to be dedicated to the public regardless of whether the element, component, or method step is explicitly recited in the claims. No claim element herein is to be construed under the provisions of 35 U.S.C. § 112, sixth paragraph, unless the element is expressly recited using the phrase "means for." Absent express definitions herein, all claim terms are to be given all ordinary and accustomed meanings that are not irreconcilable with the present specification and the file history.

The invention claimed is:

1. A modular fence system, comprising:

a plurality of wire mesh fence panels, each comprising:

a top edge and an opposed bottom edge, a left side edge and an opposed right side edge, the left side edge defining along its length a first profile, the right side edge defining along its length a second profile, the second profile being complementary to the first profile, the top edge, bottom edge, left side edge, and right side edge defining a periphery of the panel, a plurality of horizontal and vertical wire mesh barrier members residing within the periphery, a pair of aligned first helically-coiled wire hinges, carried on the left side edge of the panel, the first hinges defining a first helical orientation, and each defining a first interior bore parallel to the left side edge, and a pair of aligned second helically-coiled wire hinges carried on the right side edge of the panel, the second hinges each defining a second interior bore parallel to the right side edge, and defining a second helical orientation;

wherein the right side edge of a first said panel is disposed in side-by-side relationship along its length to the left side edge of a second said panel along its length, wherein the second helical orientation of the second hinges of the first said panel is configured to align with the first helical orientation of the first hinges of the second said panel such that the first interior bores of the first hinges of the second said panel and the second interior bores of the second hinges of the first said panel can align to allow a single fence post to extend therethrough;

a latch, the latch comprising:

a rectilinear post member having an upper end and a lower end, the post member disposed between and extending parallel to the side edges of the first and second said panels, a latch pin transversely extending from each of the upper end and the lower end of the rectilinear post member in a first direction and extending downwardly parallel to the post member, and configured to be removably engaged within the second interior bores of the second hinges of the first said panel, and a ring transversely extending from the rectilinear post member opposite each latch pin in a second direction different than the first direction, and configured to be aligned with the first interior bores of the first hinges of the second said panel; and a fence post configured to be removably inserted through the first interior bores of the first hinges of the second said panel and the aligned rings of the latch, and secured within the ground.

2. The modular fence system of claim 1, in which the top edge and the bottom edge of each panel of said plurality of fence panels reside in a single plane, and the modular fence system further includes a strengthening feature, the strengthening feature integral with a plurality of the barrier members and the strengthening feature resides outside the single plane.

3. The modular fence system of claim 1, in which as to each panel of said plurality of fence panels, a first group of the barrier members cross a plurality of the remaining members of the barrier members.

4. The modular fence system of claim 1, in which as to each panel of said plurality of fence panels, each of the barrier members has a first end and an opposed second end, and the first and second ends of the barrier members reside within the periphery.

5. The modular fence system of claim 1, in which as to each panel of said plurality of fence panels, a first group of the barrier members are generally horizontal and a plurality of the remaining members of the barrier members are generally vertical.

6. The modular fence system of claim 5, in which as to each panel of said plurality of fence panels, the generally horizontal barrier members are attached to a plurality of the generally vertical barrier members.

7. The modular fence system of claim 6, in which as to each panel of said plurality of fence panels, the generally horizontal barrier members are attached to all of the generally vertical barrier members.

8. The modular fence system of claim 1, in which as to each panel of said plurality of fence panels, the hinges are each attached to a vertical barrier member.

9. The modular fence system of claim 1, wherein the top edge, bottom edge, left side edge, and right side edge of each panel of said plurality of fence panels each define a side length, each edge being devoid of additional elements having the side length.

10. A modular fence system, comprising:

a plurality of wire mesh fence panels, each comprising:

a first plurality of barrier members residing horizontally in a parallel relationship to one another, a second plurality of barrier members residing vertically in a parallel relationship to one another, each of the horizontal barrier members attached to a plurality of the vertical barrier members, the uppermost horizontal barrier member defining a top edge to the panel, the lowermost horizontal barrier member defining a bottom edge to the panel, the left-most vertical barrier member defining a left side edge to the panel and further defining a first profile along its length, the right-most vertical barrier member defining a right side edge to the panel and further defining a second profile along its length, the second profile being complementary to the first profile, a pair of aligned first helically-coiled wire hinges carried on and extending from the left side edge, and each defining a first interior bore parallel to the left side edge, a pair of aligned second helically-coiled wire hinges each defining a second interior bore parallel to the right side edge, the second hinge carried on and extending from the right side edge of the panel, wherein the right side edge of a first said panel is disposed in side-by-side relationship along its length to the left side edge of a second said panel along its length, wherein the second interior bore of the second hinges of the first said panel is configured to align with the first interior bore of the first hinges of the second said panel such that the first interior bores of the first hinges of the second said panel and the second interior bores of the second hinges the first said panel can align to allow a single fence post to extend therethrough;

a latch, the latch comprising:

a rectilinear post member having an upper end and a lower end, the post member disposed between and extending parallel to the side edges of the first and second said panels, a latch pin transversely extending from each of the upper end and the lower end of the rectilinear post member in a first direction and extending downwardly parallel to the post member, and configured to be removably engaged within the second interior bores of the second helical hinges of the first said panel;

a handle;

a ring transversely extending from the rectilinear post member opposite each latch pin in a second direction different than the first direction, and configured to be aligned with the first interior bores of the first hinges of the second said panel; and a fence post configured to be removably inserted through the first interior bores of the first hinges of the second said panel and the aligned rings of the latch, and secured within the ground.

11. The modular fence system of claim 10, in which the top edge and the bottom edge of each panel of said plurality of fence panels are parallel and define between them a plane, and the modular fence system further includes a first strengthening feature, the first strengthening feature integral with a plurality of the vertical barrier members and the first strengthening feature resides outside the plane.

12. The modular fence system of claim 11, each panel of said plurality of fence panels further including a second strengthening feature, the second strengthening feature residing outside the plane, the first strengthening feature located proximate to the top edge, the second strengthening feature located proximate to the bottom edge.

13. The modular fence system of claim 10, in which as to each panel of said plurality of fence panels, each of the horizontal barrier members is attached to each of the vertical barrier members.

14. The modular fence system of claim 10, in which the first and second hinge of each panel of said plurality of fence panels are helical, are complementary, are each attached to a vertical barrier member, and are each outboard of the panel.

15. The modular fence system of claim 10, wherein the top edge, bottom edge, left side edge, and right side edge of each panel of said plurality of fence panels each define a side length, each of the edges being devoid of additional elements of said side length.

16. The modular fence system of claim 10, in which the uppermost horizontal barrier member, the lowermost horizontal barrier member, the left-most vertical barrier member, and the right-most vertical barrier member of each panel of said plurality of fence panels define a panel periphery, and the entireties of the other horizontal and vertical barrier members reside within the panel periphery.

17. A modular fence system, comprising:

a plurality of identical wire mesh fence panels, each comprising:

a first plurality of barrier members being identical, being rectilinear, and residing horizontally in parallel spaced-apart relationship to one another, a second plurality of barrier members residing vertically in parallel spaced-apart relationship to one another, each horizontal barrier member attached to a plurality of vertical barrier members, the uppermost horizontal barrier member, the lowermost horizontal barrier member, the left-most vertical barrier member, and the right-most vertical barrier member together defining a periphery of the fence panel, the uppermost horizontal barrier member and the lowermost horizontal barrier member being parallel and defining between them a plane, the left-most vertical barrier member defining a first profile along its length and the right-most vertical barrier member defining a second profile along its length, the second profile being complementary to the first profile, a first vertical barrier member and a second vertical barrier member of the second plurality being identical, each being formed to include along its length a third profile, the third profile residing outside the plane, wherein the third profiles of the first and second vertical barrier members together define a first strengthening feature, a pair of aligned first helically-coiled wire hinges carried on the left side edge of the panel and each defining a first interior bore parallel to the left side edge, and a pair of aligned second helically-coiled wire hinges carried on the right side edge of the panel, the second helical hinges each defining a second interior bore parallel to the right side edge, and wherein the right side edge of a first said panel is disposed in side-by-side relationship along its length to the left side edge of a second said panel along its length, wherein the second interior bores of the second helical hinges of the first said panel are configured to align with the first interior bores of the first helical hinges of the second said panel such that the first interior bore and the second interior bore can align to allow a single fence post to extend through the first interior bores of the first hinges of the second said panel and the second interior bores of the second hinges the first said panel when said first and second panels are assembled;

a latch, the latch comprising:

a rectilinear post member having an upper end and a lower end, the post member disposed between and extending parallel to the side edges of the first and second said panels, a latch pin transversely extending from each of the upper end and the lower end of the rectilinear member in a first direction and extending downwardly parallel to the post member, and configured to be removably engaged within the second interior bores of the second helical hinges of the first said panel;

a ring transversely extending from the rectilinear post member opposite each latch pin in a second direction different than the first direction, and configured to be aligned with the first interior bores of the first hinges of the second said panel; and a fence post configured to be removably inserted through the first interior bores of the first hinges of the second said panel and the aligned rings of the latch, and secured within the ground.

18. The modular fence system of claim 17, wherein as to each panel of said plurality of fence panels, each of the horizontal barrier members is attached to all of the vertical barrier members.

19. The modular fence system of claim 17, wherein as to each panel of said plurality of fence panels, the first vertical barrier member and the second vertical barrier member of the second plurality are each also formed to include along its length a fourth profile, the fourth profile residing outside the plane, wherein the fourth profiles of the first and second vertical barrier members together define a second strengthening feature.

20. The modular fence system of claim 19, in which as to each panel of said plurality of fence panels, the first strengthening feature is disposed proximate the uppermost horizontal barrier member and is parallel thereto, and the second strengthening feature is disposed proximate the lowermost horizontal barrier member and is parallel thereto.

21. The modular fence system of claim 17, wherein the uppermost horizontal barrier member, the lowermost horizontal barrier member, the left-most vertical barrier member, and the right-most vertical barrier member of each panel of said plurality of fence panels each define a side length, each uppermost horizontal barrier member, lowermost horizontal barrier member, left-most vertical barrier member, and right-most vertical barrier member being devoid of additional elements of said side length.

22. The modular fence system of claim 17, in which as to each panel of said plurality of fence panels, a horizontal barrier member is attached to the first strengthening feature.

23. The modular fence system of claim 17, in which as to each panel of said plurality of fence panels, the first said panel is disposed adjacent to the second said panel, the second hinge of the first said panel is aligned with the first hinge of the second said panel, and the post is interfitted within the first and second hinges, extending through both the first interior bore and the second interior bore.

* * * * *